US005189745A

United States Patent [19]

Workman et al.

[11] Patent Number: 5,189,745

[45] Date of Patent: Mar. 2, 1993

[54] MATTRESS CONSTRUCTION FOR SUPPORT STRUCTURE CONTAINING HUMAN WASTE COLLECTION SYSTEM

[75] Inventors: James P. Workman, Spring Hill, Kans.; Thomas S. Hargest, Charleston, S.C.; Myles D. Nolte, Ottawa, Kans.

[73] Assignee: Burke Mobility Products, Inc., Kans.

[21] Appl. No.: 675,656

[22] Filed: Mar. 27, 1991

Related U.S. Application Data

[63] Continuation-in-part of Ser. No. 314,716, Feb. 23, 1989, Pat. No. 5,058,222.

[51] Int. Cl.[5] ..... A61G 7/02

[52] U.S. Cl. ..... 5/604; 5/450; 5/463; 5/473; 5/481; 4/456; 4/480

[58] Field of Search ..... 5/90, 481, 463, 450, 5/453, 473, 604; 4/480, 483, 462, 456; 297/DIG. 1

[56] References Cited

U.S. PATENT DOCUMENTS

| | | | |
|---|---|---|---|
| 1,981,666 | 4/1934 | Ridley | 4/456 |
| 2,932,831 | 4/1960 | Keathley et al. | 5/90 |
| 2,961,665 | 4/1960 | Burth | 5/90 |
| 3,285,145 | 1/1967 | Ericson . | |
| 3,475,767 | 11/1969 | Friesen et al. . | |
| 3,521,311 | 7/1970 | Cohen | 5/464 |
| 3,577,989 | 5/1971 | Anderson | 128/283 |
| 3,619,822 | 11/1971 | Carmichael . | |
| 3,719,962 | 3/1973 | Burkley | 5/90 |
| 3,729,107 | 4/1973 | Present | 53/24 |
| 3,777,739 | 12/1973 | Raitto . | |
| 3,781,922 | 1/1974 | Ericson . | |
| 3,798,686 | 3/1974 | Gaiser | 5/450 |
| 3,802,418 | 4/1974 | Clayton | 128/246 |
| 3,872,525 | 3/1975 | Lea et al. | 5/451 |
| 3,878,572 | 4/1975 | Eriksson . | |
| 3,920,179 | 11/1975 | Hall | 128/DIG. 24 |
| 3,933,636 | 1/1976 | Daniels | 210/71 |
| 4,039,363 | 8/1977 | Robertson | 5/481 |
| 4,067,335 | 1/1978 | Silvanov | 604/328 |
| 4,091,930 | 5/1978 | Buckner et al. | 206/469 |
| 4,139,488 | 2/1979 | Knotik et al. | 106/97 |
| 4,244,920 | 1/1981 | Manschot et al. | 220/306 |
| 4,271,546 | 6/1981 | Martin | 5/90 |
| 4,387,731 | 6/1983 | Calanni | 604/333 |
| 4,394,784 | 7/1983 | Swenson et al. | 5/453 |
| 4,425,676 | 1/1984 | Crane | 5/453 |
| 4,449,984 | 5/1984 | Cruz | 604/319 |
| 4,472,848 | 9/1984 | Newman | 5/463 |
| 4,495,209 | 1/1985 | Whiteside | 53/471 |
| 4,539,793 | 9/1985 | Malek | 53/469 |
| 4,631,762 | 12/1986 | Fugett | 5/90 |
| 4,660,354 | 4/1987 | Lancaster | 53/469 |
| 4,685,913 | 8/1987 | Austin | 604/349 |
| 4,694,520 | 9/1987 | Paul et al. | 5/453 |
| 4,754,508 | 7/1988 | Nishiguchi | 5/90 |
| 4,821,348 | 4/1989 | Pauna | 5/90 |
| 4,833,457 | 5/1989 | Graebe et al. | 5/455 |
| 4,995,124 | 2/1991 | Wridge, Jr. et al. | 5/450 |
| 5,077,845 | 1/1992 | Togunaka et al. | 5/463 |

FOREIGN PATENT DOCUMENTS

| | | | |
|---|---|---|---|
| 984604 | 2/1965 | United Kingdom | 5/450 |

OTHER PUBLICATIONS

Table 1—Details and typical uses of Filtercrest ® Industrial Foams-undated technical brochure.

Table 2—Physical properties of Filtercrest ® Industrial Foams-undated technical brochure.

*Primary Examiner*—Alexander Grosz

*Attorney, Agent, or Firm*—Kokjer, Kircher, Bowman & Johnson

[57] ABSTRACT

A system is provided for the collection, storage and disposal of human wastes. An externally positionable patient interface directs wastes to a storage container. Accumulated wastes are sealed within the storage container to prevent cross-contamination. The patient interface is extendible through an aperture formed within a seat portion of a support structure which can be converted between bed and chair configurations. A mattress includes a permeable core and an air-impermeable covering bonded to the core. The mattress is inflatable to provide the desired supporting pressure for the patient and also to assist in positioning the patient in relation to the aperture and the patient interface.

16 Claims, 3 Drawing Sheets

MATTRESS CONSTRUCTION FOR SUPPORT STRUCTURE CONTAINING HUMAN WASTE COLLECTION SYSTEM

This is a continuation-in-part of copending patent application Ser. No. 314,716, filed on Feb. 23, 1889, now U.S. Pat. No. 5,058,222.

BACKGROUND OF THE INVENTION

This invention relates in general to human waste disposal systems and, more specifically, to an apparatus and method for the collection, containment and disposal of human wastes. A particular aspect of the invention relates to an improved mattress construction for said apparatus and method.

Two basic devices currently exist for collecting and disposing of defecated wastes from patients who, because of physical infirmity or other reasons, are unable to utilize a conventional toilet. A bed pan configured to the patient's buttocks is one device which is commonly used. Utilization of such a device, however, is necessarily limited to those patients who are able to anticipate the need for its use. Senile, unconscious or seriously ill individuals, as well as those who are unable to call for assistance would be unable to use a bed pan. Incontinent patients, that is, those patients with uncontrolled bladder and bowel movements, do not have sufficient advance warning to call for or safely position a bed pan without risk of an accident occurring.

Those who are able to use a bed pan must endure the embarrassment of summoning a nurse to bring the device and position and remove it from beneath the patient. Moreover, the use of a bed pan while the patient is in bed requires that the individual assume either a horizontal position or a sitting position with the legs extending horizontally. Either position is an unnatural physiological position and many patients find it difficult to adapt to the use of a bed pan.

In addition to the problems that the bed pan presents for the patient, assisting personnel likewise are subjected to an objectionable situation. First the nurse may be required to physically lift the individual to ensure proper placement. After use, the individual must be cleaned and the pan removed from beneath the patient without spilling its contents. This can be a difficult proposition at best as the nurse must lean over the bed and somehow support the patient while gently removing the device.

Bed pans also expose assisting personnel to possible contamination from the pan contents. When the patient is afflicted with a communicable disease such as hepatitis or acquired immune deficiency syndrome (AIDS), such cross contamination may be a life threatening exposure. Although protective items such as caps, gowns, rubber gloves and masks may be utilized, the risk of contamination remains great because the laborious process required to position and remove the pan may cause a breach of contamination safeguards. Moreover, this recurring risk is encountered by nursing staff each time a patient has a bowel movement, which can be as often as twenty to thirty times per day.

Adult diapers have been used as an alternative to bed pans, especially with seriously ill patients. Again, placement and removal of a device such as this can be physically taxing for both the nurse and the patient. Conscious patients must endure the discomfort and embarrassment of a soiled diaper and assisting personnel are exposed to the dangers of cross-contamination when changing the diaper and cleaning up. Because of the many problems which result from usage of diapers, they are a particularly undesirable solution for the patient who is unable to utilized toilet facilities.

One alternative to the bed pan and adult diaper is described in U.S. Pat. No. 4,067,335 which disclosed a device which is fixed internally of a individual and coupled with an elongated receiving and storage tube. As a portion of the tube is filled, it is sealed and may be separated from the unfilled portion for disposal. The invasive nature of this device, however, may cause abrasion and pressure sores as well as patient discomfort. Skilled assistance may also be required to ensure proper internal placement.

SUMMARY OF THE INVENTION

It is an object of this invention to provide an improved mattress construction for a human waste collection device that may be utilized by a patient while in a bed or chair and can be operated by the patient without requiring the assistance of nursing or other personnel.

It is a further object of this invention to provide an improved opening mechanism for an aperture in the mattress so that the components of the waste collection device may be more reliably placed into the correct operational position.

It is another object of this invention to provide a human waste collection device which provides for the collection, containment and disposal of the wastes in a manner which substantially reduces the exposure of assisting personnel to the risk of cross-contamination.

It is also an object of this invention to provide a waste collection device which stores an accumulation of generated wastes remotely from the patient so that disposal of the waste takes place at less frequent intervals to reduce the risk of cross-contamination.

It is a still further object of this invention to provide a support structure which incorporates a waste collection and storage device and which may be used as either a bed or chair so that an individual may comfortably remain on the structure for an extended period of time and may attend to bodily functions without leaving the support structure.

It is yet another object of this invention to provide a noninvasive waste collection and storage device which may be used by incontinent individuals without requiring continual assistance by nursing personnel.

It is a yet further object of this invention to provide an externally positionable waste collection device which may be utilized with a support structure such as a bed or chair and which seals the collected wastes to prevent cross-contamination during disposal of the collected wastes.

To accomplish these and other related objects of the invention, a support structure is provided which may be converted between bed and chair configurations. The support structure is provided with a waste collection, containment and disposal mechanism for the closed collection of human wastes to substantially reduce the likelihood of cross-contamination. The mechanism comprises means such as an interfacing saddle which is coupled with a container and is externally engageable with an area at least partially surrounding a patient's anal region for directing excreted wastes to the container for collection and containment. The container is sealable for disposal without danger of spillage of the contents. The support structure also includes an aperture in a support surface of the structure, which aperture may be moved from a normally closed position to an open position to allow the interfacing saddle and the patient's anal region to brought into engagement or slightly spaced from such engagement. The opening mechanism for the aperture includes rollers which are pivotable to pull on bands which extend through the aperture. Tensioning of the bands by pivoting of the rollers causes the aperture to open, while release of the bands permits closure of the aperture.

An improved mattress, method of construction and method of use of the mattress are of particular importance to the present invention. The mattress forms at least part of the patient support surface and may include the aperture. The mattress comprises an inflatable cushion and a foam pad attached to the top surface of the cushion. The cushion comprises a permeable core having a reticulated or open cell foam type construction and a substantially air-tight outer covering which is bonded to the core. The mattress may be inflated and deflated to permit vertical positioning of a patient supported thereon. The mattress may also include selectively inflatable segments for lateral positioning of the patient. The cushion is preferably constructed by applying one or more coatings of a rubber or rubber-like material to the outer surface of the foam core and allowing the rubber to penetrate a preselected distance into the foam matrix. When cured, the rubber forms an elastic outer covering which permits the mattress to be pressurized.

BRIEF DESCRIPTION OF THE DRAWINGS

In the accompanying drawings in which like reference numerals are used to indicated like parts in the various views.

DESCRIPTION OF THE PREFERRED EMBODIMENT

Figure 1:
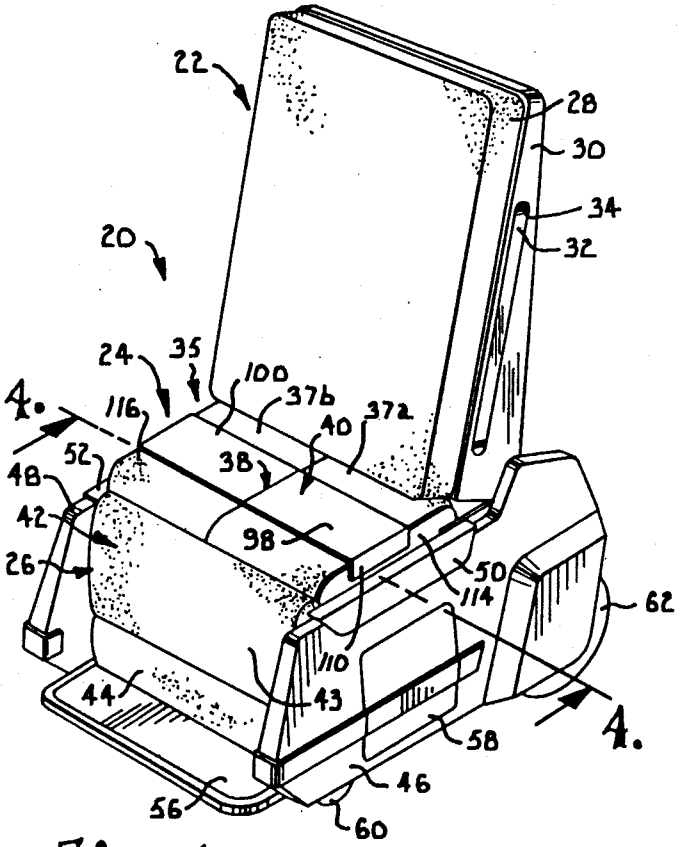
FIG. 1 is a side perspective view of a patient support structure which incorporates a closed waste collection system of the present invention, the support structure being adjusted to a chair configuration.

Turning now to the drawings in greater detail and initially to FIG. 1, an adjustable patient support structure incorporating a waste collection, containment and disposal system of the present invention is represented generally by the numeral 20. Support structure 20 includes a head portion 22, a seat portion 24 and a foot portion 26 which cooperatively define a support surface for the patient. The head and foot portions 22 and 26 are adjustable so that the support structure may be moved between the illustrated chair configuration and a bed configuration. Seat portion 24 may also be adjustable to facilitate positioning of the patient in the desired orientation.

Head portion 22 includes a mattress 28 coupled with an adjustable support frame 30. The support frame includes a pair of extendible rails 32 housed within openings 34 formed on opposite sides of the frame. Rails 32 are normally maintained in a recessed position when the support structure 20 is positioned in a chair configuration. When the structure is positioned in a bed configuration the rails may be extended outward and then pivoted upward to lock in a position to serve as side rails.

Turning additionally to FIGS. 2 and 4–6, seat portion 24 includes a mattress 35 on a support frame 36. The seat mattress 35 comprises two abutting segments 37*a* and 37*b* which form a centrally positioned vertically extending aperture 38. Alternately, the seat mattress may comprise a single segment having the aperture formed therein. Relief cuts 39*a* which extend vertically through the mattress segments are provided to facilitate opening of the aperture 38. The relief cuts 39*a* are spaced apart and extend perpendicularly from the abutting edges of the mattress segments into each segment to define a compressible mattress portion 39*b* which forms the aperture 38 when compressed. A series of kerfs 39*c* are provided on the undersurface of the mattress segments to aid in compression of the mattress portions 39*b*. An opening mechanism 40, which will be subsequently described in greater detail, is provided for moving the aperture between open and closed positions.

Returning to FIG. 1, foot portion 26 also includes a mattress 42 which is divided into two segments 43 and 44 and is coupled with an adjustable support frame (not shown). Mattresses 28, 35 and 42 may be interconnected or separate if desired. The head and foot support frames are adjustable between generally horizontal positions and generally vertical positions.

Side frame members 46 and 48 which enclose portions of the sides of support structure 20 include a pair of armrests 50 and 52 which are positioned adjacent the seat portion 24. Armrests 50 and 52 each include a pair of telescoping support posts (not shown) which allow vertical extension of the armrests. The armrests may also be moved inwardly and outwardly to other desired positions. A footrest 56 extends horizontally between the side frame members 46 and 48 below the foot portion 26 for use when support structure 20 is in the chair configuration. An access panel 58 is provided in side frame member 46 to permit access to an interior compartment which houses selected components of the waste collection, containment an disposal system.

Mobility of support structure 20 is provided by a pair of front wheels 60 and a pair of larger diameter rear wheels 62. Powered propulsion of either the front or rear wheels may be provided by a suitable drive mechanism (not shown) such as a singular motor or individual motors at each rear wheel. Steering may be accomplished by a joy stick or other four axis control device which allows for forward, rearward and sideward directional control by individually powering or braking of each of the drive wheels. Suitable electronic, pneumatic, hydraulic or mechanical components may be used to accomplish the driving or braking of each drive wheel. The control device could be a pendant device or a device integral with one of the armrests 50 and 52. A selfcontained power source such as NiCad or gel cell batteries is preferably utilized for powering the drive mechanism as well as the various components of support structure 20 which require a power source. Other components and features of the support structure 20 are more fully described in our copending application Ser. No. 314,716 now U.S. Pat. No. 5,058,222, which is incorporated herein by reference in its entirety.

Turning to FIGS. 7–11, one embodiment of a disposable waste collection apparatus which is used in conjunction with support structure 20 will now be described. The waste collection apparatus is broadly designated by the numeral 64 and is housed within an internal compartment of the support structure 20. Apparatus 64 includes a storage container 66 having a flanged upper rim 68 and a patient interfacing saddle 70 which is connected to the upper rim 68 of the container. A series of tabs 72 are provided on the container to interlock with complementary positioned slots 74 in a downturned skirt 76 of a container lid 78. The skirt is sized so that the lid completely encloses the saddle 7 when disposal of the container is desired. A handle 80 is provided in a recessed well in the top of the lid 78. One or more fittings 82 are provided on the undersurface of the container rim 68 for connection with a hose 84 for introduction of water and/or air into the saddle 70.

The container 66 may be formed of rigid materials to support the saddle and an extendible platform provided to elevate the interfacing saddle 70 into the aperture 38 formed in the overlying seat mattress 35. Alternately, a suitable extendible frame may be provided to engage the undersurface of the container rim 68 and thereby support and elevate the saddle 70.

The patient interfacing saddle 70 which is mounted on waste storage container 66 includes a ring shaped upper surface 85 configured to sealingly engage the buttocks 86 or annular region of the patient. A centrally open region of the saddle directs excreted wastes directly to the container 66 for storage. Container 66 may include a gelling material to partially solidify the waste received in the container to allow the container to be removed and transported with less danger of spillage of the waste. A forward end of the saddle upper surface may optionally include an upwardly projecting splash guard 87.

Returning to FIGS. 4–6, opening mechanism 40 moves aperture 38 from its normally closed position shown in FIG. 4 to an open position shown in FIG. 5 to permit elevation of saddle 70 into engagement with or slightly spaced from the patient's buttocks 86. Mechanism 40 comprises adjacently positioned pivoting support brackets 88 and 90 which are connected to a suitable frame (not shown) by pivot pins 92. The pivoting support brackets have upper surfaces sized and shaped to support a portion of the mattress 35 overlying an opening provided in the mattress frame 36. A suitable mechanism (not shown is coupled with support brackets 88 and 90 for effecting pivoting movement thereof between the closed position shown in FIG. 4 and the open position shown in FIG. 5. It is preferred that the support brackets 88 and 90 remain slightly spaced apart in the closed configuration to prevent injury to any body part which might be placed within the open aperture 38.

The opening mechanism 40 also includes rollers 94 and 96 mounted to pivoting support brackets 88 and 90 and flexible bands 98 and 100 which engage the rollers. Both rollers comprise an elongated cylinder 102 which turns on a rigid wire support 104 mounted to a traverse rod 106. The wire support 104 extends outwardly from the traverse rod 106 to position the rotatable cylinder 102 beneath a slot 108 formed in the mattress support frame 36. The wire support also includes a dogleg to place the cylinder 102 in the same plane as the top surface of the respective support bracket 88 or 90.

The flexible bands 98 and 100 are coupled with the support brackets 88 and 90 to open the aperture 38 upon pivoting of the brackets 88 and 90. Bands 98 and 100 have first ends 110 and 112 attached by Velcro ® strips or other suitable connectors to the opposed vertical walls 114 and 116 of the mattress support frame 36. The bands then extend inwardly along the top surface of mattress 35 to the centrally positioned aperture 38 and downward along the sidewalls of the aperture. The bands then extend outwardly between the undersurface of the mattress 35 and the top surface of support frame 36 and are fed through the slots 108 and around rollers 94 and 96. The bands are then fed back up through slots 108 and are secured at their second ends 118 and 120 to the top surface of the mattress support frame 36 by suitable anchors 122 such as Velcro ® strips. A suitable guide (not shown) may be used to aid in feeding the bands around the rollers By wrapping the bands 98 and 100 around the rollers 94 and 96, the pivoting movement of support brackets 88 and 90 to the open position of FIG. 5 causes the bands to exert a spreading force on the sidewalls of the aperture to form an opening for passage of saddle 70. Likewise, pivoting of the supports to the closed position of FIG. 4 allows return of the aperture to a closed position.

Figure 2:
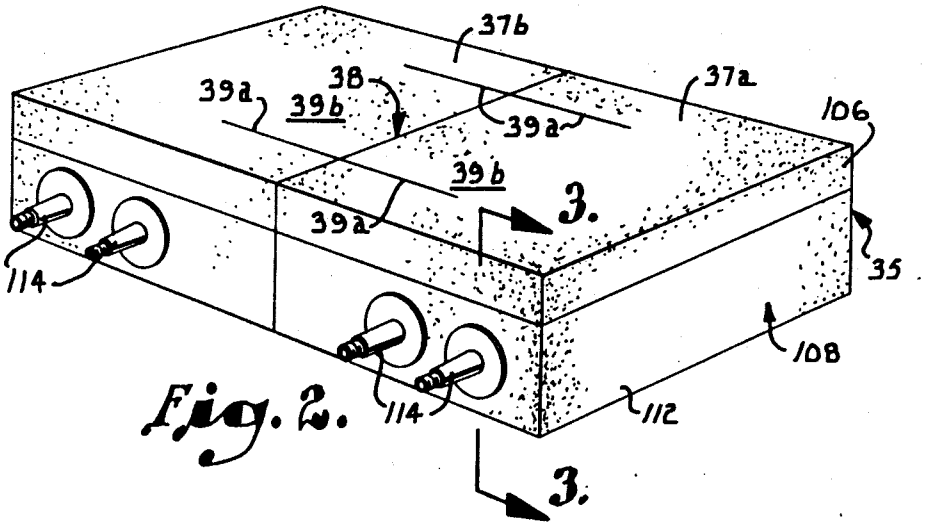
FIG. 2 is an enlarged side perspective view of an improved mattress construction of the present invention.
Figure 3:
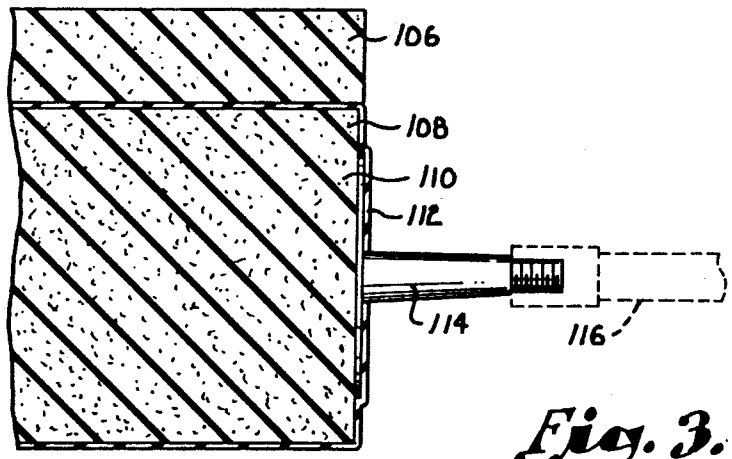
FIG. 3 is a fragmentary elevational view of the mattress construction shown on an enlarged scale and taken in vertical section along line 3—3 of FIG. 2.

Turning to FIGS. 2 and 3, the improved mattress construction of the present invention will now be described in greater detail. Mattress 35 includes an upper foam pad 106 which is cemented to an inflatable lower cushion 108. Upper pad 106 is provided principally for patient comfort and may be formed from any of various types of foam or other products.

The inflatable cushion 108 comprises a core 110 encased by an outer covering 112. Suitable air valves 114 of known construction are provided in the covering for permitting air pressure to be introduced within and released from inflatable cushion 108.

The cushion core 110 desirably comprises a material having a matrix structure which is highly porous and highly permeable. The high porosity and permeability are required to allow air to flow freely and evenly through the matrix structure as the cushion is pressurized. The core material should also have a tensile strength which will allow the integrity of the matrix structure to be maintained as the cushion is pressurized and depressurized. Examples of suitable materials for the core included opened celled and reticulated foams. Reticulated foam has higher permeability and elasticity in comparison to most foam products in which the entire bubble structure is retained in the resulting matrix.

Materials particularly suited for use in core 110 include reticulated foams having 15–50 pores per inch (ppi), with 35 ppi being generally preferred. An example of a suitable commercially available reticulated foam is an industrial, RO-series, polyether foam available from Crest Foam Corp. under the FILTERCREST registered trademark. The pores per inch measure is determined by counting the number of pores per linear inch along a surface of the foam.

The rubber-like outer covering 112 of mattress 35 may comprise various materials capable of bonding to the core 110 and presenting a substantially air-impermeable layer for retaining air pressure within the mattress. Although various materials may be used to form the outer covering, the materials chosen must be capable of penetrating the matrix structure of the core to bond to the cell walls, be substantially air-tight, and be elastic to allow the mattress to expand to some degree as pressure within the mattress increases.

A secure bond between the outer covering 112 and the core 110 is necessary to permit the rigidity of the mattress core to be varied by increasing or decreasing the pressure within the mattress. By bonding the covering to the core, air movement and pressure within the mattress is restricted to the small interstitial passages within the matrix structure of the core. External pressure on the mattress is distributed and diffused by these passages, thereby producing a support surface with superior stability across a range of inflation pressures. In comparison, an air mattress constructed without bonding the outer covering to the core would permit unimpeded airflow between the core and the outer covering and would be far less stable than the mattress of the present invention.

It has been found that materials such as latex rubber are well suited for use as outer covering 112 and will form the desired bond with the foam core 110 when applied in a liquid state and allowed to cure. When latex rubber is used, it is preferable applied to the outer surface of the foam core 110 in a multi-step process. A first coat of liquid rubber is applied, such as by brushing, to the foam core and allowed to penetrate into the interstices of the foam matrix to a predetermined depth. In order to ensure a secure bond between the foam core and the outer covering, it is important that this first application of liquid rubber penetrate the outer surface of the foam to a depth of at least one cell wall. As the liquid rubber penetrates the foam, it coats the cell walls of the matrix structure and forms a secure bond when cured because of the large surface area of contact between the materials. After the first coat has cured, additional coats of liquid rubber are then applied and cured until an impermeable outer covering 112 of the desired thickness is formed.

Pressure within the mattress 35 may be varied by supplying air from a suitable compressor (not shown) through pneumatic lines 116 or withdrawing air through the same or different lines. As air is supplied to the foam core 110, pressure within the mattress and the rigidity of the core increase. As air is removed from mattress 35, the pressure within the mattress and the rigidity of the core decrease. It can thus be seen that varying the air pressure within the mattress can cause changes in the vertical positioning of a patient supported on the mattress. Lateral positioning of the patient may also be effected by varying the air pressure between adjacent portions or segments of the mattress.

In use, the support structure 20 provides a support surface which may be adjusted between bed and chair positions to place a patient in sitting, prone or supine and various intermediary positions. Structure 20 also advantageously provides for the collection, containment and disposal of wastes generated by the patient so that the patient need not leave the structure to attend to bodily functions. The waste collection apparatus 64 may be operated without the assistance of nursing personnel and collects and stores the wastes in a closed manner which substantially reduces the risk of cross-contamination.

The waste collection apparatus 64 is normally maintained in its lowered storage position until needed by the patient. When the patient needs to attend to bodily functions, the patient operates suitable controls to position the support structure 20 in a chair-like or other desired configuration. The operating controls are then utilized to open the aperture 38 and elevate the waste collection saddle 70.

Figure 5:
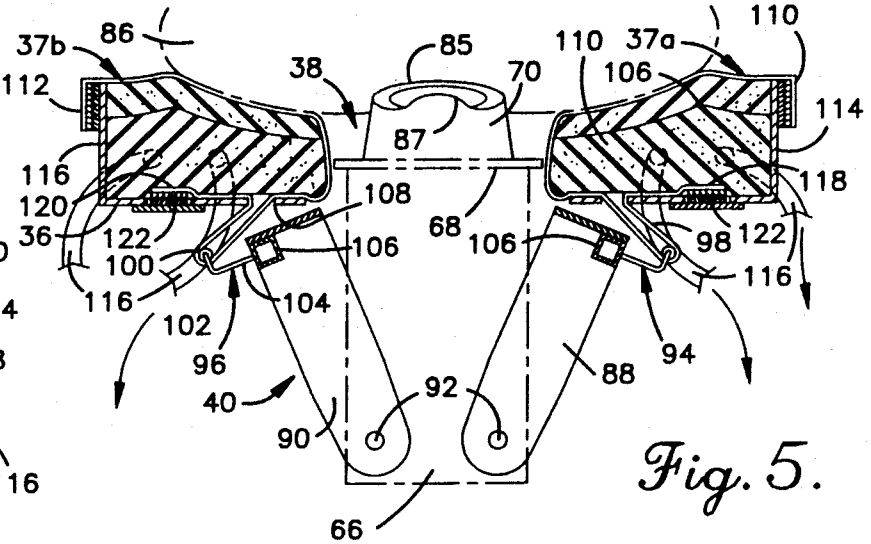
FIG. 5 is a vertical cross-sectional view of the patient support structure similar to the view shown in FIG. 4 but with a portion of the waste collection system shown elevated through an aperture in the support structure and with the mattress show partially deflated.

As illustrated in FIG. 5, the aperture 38 is opened by outward pivoting of support 88 and 90 and resulting compression of the aperture sidewalls by bands 98 and 100. As the aperture is being opened, suitable controls reduce the air pressure within mattress 35 from the normal support pressure by removing air from within the mattress through lines 116. The saddle 70 is then elevated into the aperture to bring the top surface 85 of saddle 70 into registry with the patient's buttocks.

Although it is preferred that the top surface 85 of the elevated saddle touches the patient's buttocks 86 along at least an arc partially surrounding the anal region, the patient remains supported by the mattress segments **37*a* and 37*b* and there need not be physical contact between the patient and the saddle. The centrally opening aperture 38 is particularly advantageous in this regard as it enables the mattress segments to continue to support the patient even after the aperture is opened, thereby reducing or eliminating the force which must be borne by the waste collection saddle 70. Moreover, since the patient does not need to be repositioned on the mattress during operation of the aperture, even infirm patients may readily utilize the waste collection apparatus 64** without assistance from others.

In cases where the patient carries a communicable disease, it is important that the waste be totally received by the saddle 70. As such, a saddle formed to contact, and therefore seal against, the patient's buttocks about the entire anal region may be preferred.

Figure 6:
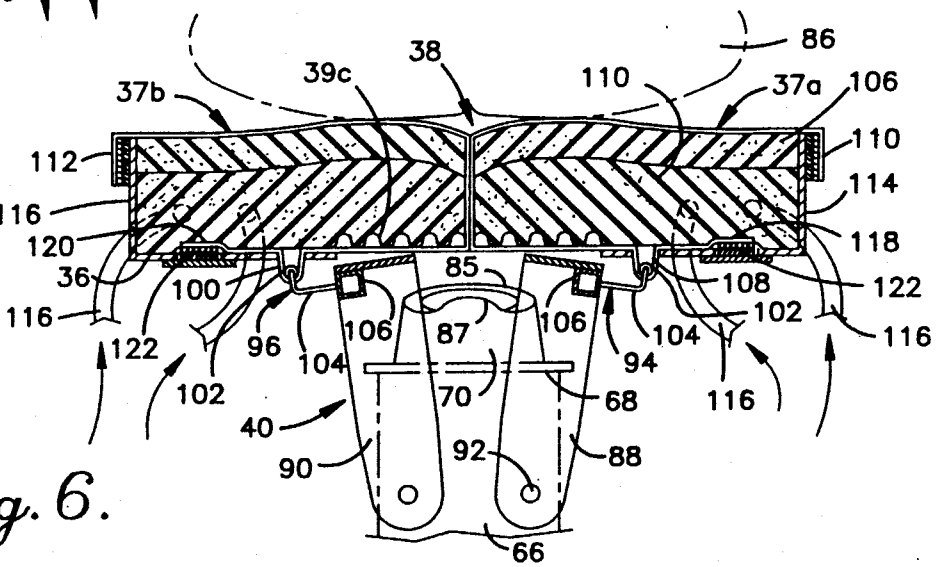
FIG. 6 is a vertical cross-sectional view of the patient support structure similar to the view shown in FIG. 5 but with the waste collection system shown returned to the storage position and the mattress reinflated to a pressure greater than that illustrated in FIG. 4.
Figure 4:
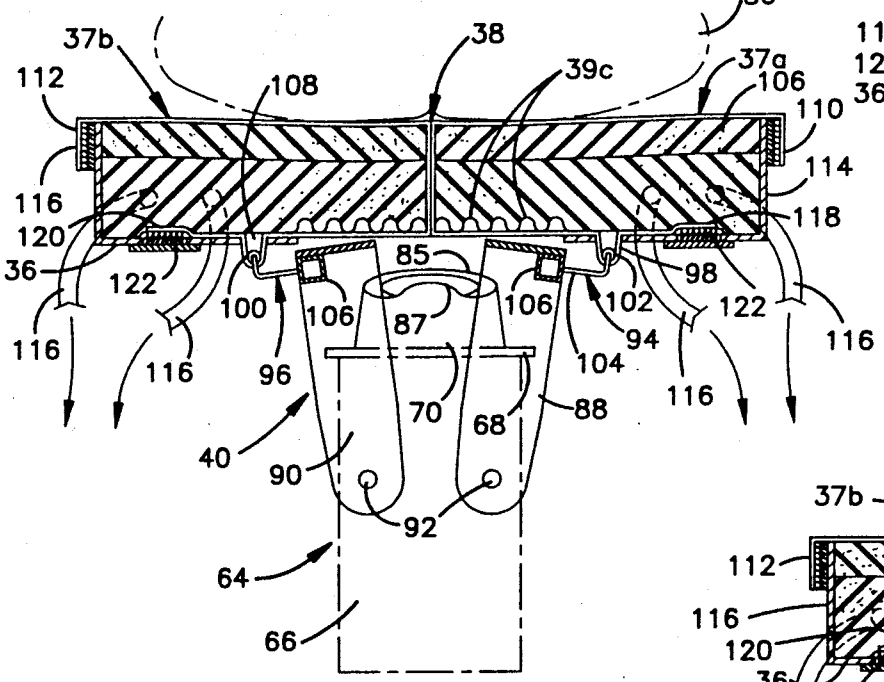
FIG. 4 is an enlarged vertical cross-sectional view of the support structure taken along line 4—4 of FIG. and with portions of the support structure and collection system removed for purposes of illustration.
Figure 10:
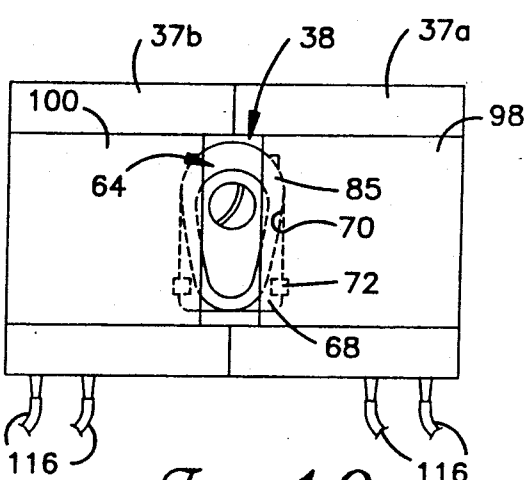
FIG. 10 is a top plan view of the patient support structure similar to the view shown in FIG. 9 but with an aperture in the mattress shown partially opened.
Figure 11:
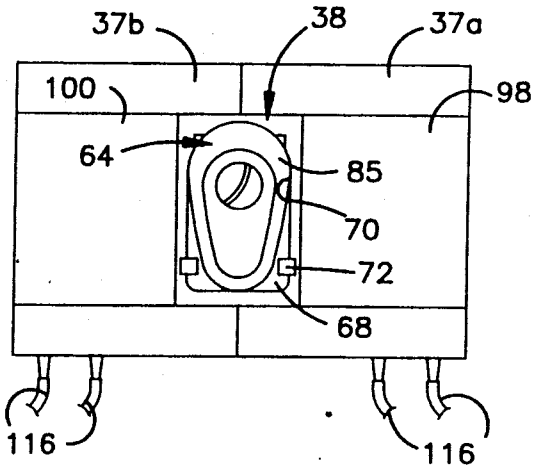
FIG. 11 is a top plan view of the patient support structure similar to the view shown in FIG. 10 but showing the aperture in the support structure in a fully opened position with the patient interfacing saddle being elevated into the aperture.
Figure 8:
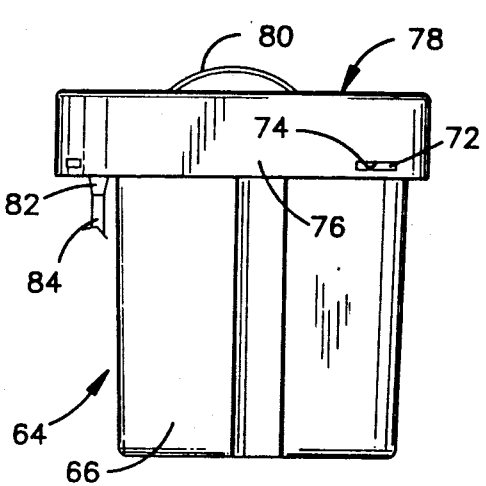
FIG. 8 is a side elevational view of the storage container and lid shown in FIG. 7, but shown on a reduced scale and with the lid applied over the patient interfacing saddle to seal the container.
Figure 9:
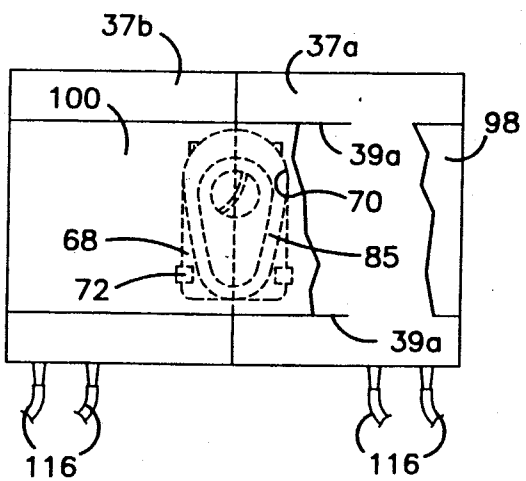
FIG. 9 is a top plan view of the patient support structure, shown on a reduced scale and with the patient interfacing saddle and storage container shown in broken lines and a portion of an opening mechanism band broken away to illustrate construction details of the mattress.
Figure 7:
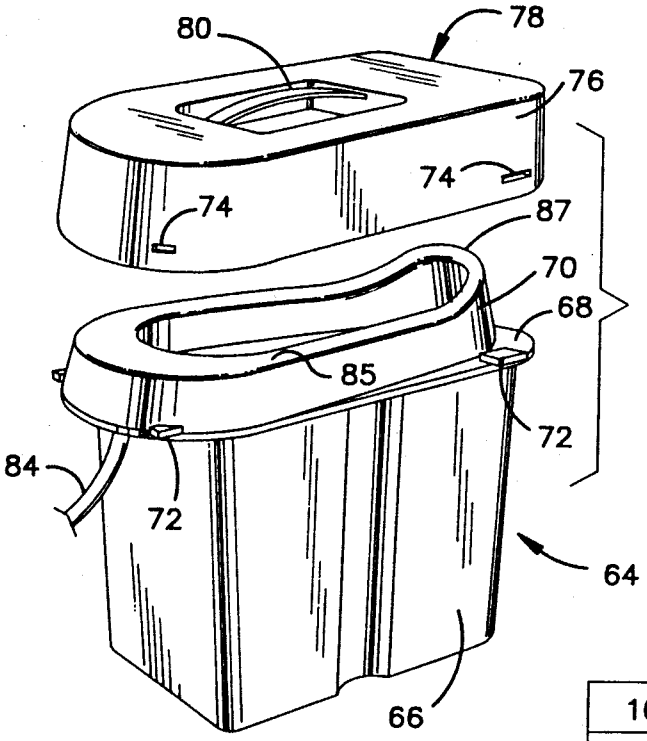
FIG. 7 is an exploded side perspective view, shown on an enlarged scale, of a patient interfacing saddle mounted on a storage container and a lid for such container.

After wastes have been directed by the saddle collection basin into storage container 66, residual wastes may be removed from the basin by a water rinse. Patient cleansing and drying may also take place as described in our copending application Ser. No. 314,716, now U.S. Pat. No. 5,058,222. The saddle is then lowered as shown in FIG. 6 and the support brackets 88 and 90 are pivoted inwardly to close the aperture. As the aperture is being closed, mattress 35 is reinflated through lines 116 to a pressure in excess of the normal supported pressure. This increased pressure aids in closure of the aperture and also causes the mattress to expand and lift the patient upwardly away from the closing aperture, thereby reducing the opportunity for the aperture to close upon portions of the patient's body. When the aperture has safely closed, the air pressure in the mattress is returned to the normal support pressure.

The waste collection apparatus 64 may be readily removed for disposal by simply opening the aperture 38 as previously described and apply the lid 78 to the storage container 66. The interlocking tabs 72 and slots 74 permit the apparatus to be lifted by handle 80 vertically through the aperture. The deep skirt 76 on the lid completely covers the saddle 70 to prevent any crosscontamination during removal of the waste collection apparatus. After removal, the apparatus 64 may be disposed of and a new apparatus placed into position through aperture 38. The apparatus may also be inserted and removed through the side access door 58 if the various internal linkages of structure 20 permit such access.

In order to ensure that the patient is vertically aligned over the saddle 70 during usage of apparatus 64, suitable pressure sensors (not shown) may be coupled with each of adjacent mattress segments 37*a* and 37*b*. If the pressure within one mattress segment varies significantly from the pressure within the other mattress segment, this indicates that the patient is not centrally positioned on the mattress 35. If the patient should attempt to activate the aperture opening mechanism 40 while there is a significant variation between the mattress segment pressures, an audible or visual alarm may be sounded to alert the patient to the misalignment. Such an alarm could inform the patient of the direction of movement necessary to achieve proper alignment, or signal a monitored separate location, such as a nursing station, of the attempt to activate mechanism 40. Personnel at the monitored location could then instruct the patient or provide manual assistance. If desired, the pressure within the mattress segments may be selectively adjusted to move the patient laterally to the correct position. For instance, if the patient is laterally positioned too far onto mattress segment 37*a*, the pressure sensors will register a greater pressure in segment 37*a* than in segment 37*b*. Mattress segment 37*a* may then be further inflated and segment 37*b* deflated to laterally shift the patient into the correct position centered over the saddle 70. Once the patient is in the correct position, the aperture is allowed to open and use of the waste collection apparatus 64 proceeds as described above.

The permeable foam core 110 may also be utilized in other novel therapeutic applications. For instance, the foam core may be charged with a soothing or therapeutic gas which can be directed through openings (not shown) in the outer covering 112 to afflicted localized areas of a patient supported thereon. Thus, a patient suffering from a bed sore may rest on the mattress 35 with the bed sore positioned over an opening in the mattress outer covering 112. A therapeutic gas which is charged to the mattress core 110 through pneumatic lines 116 is then directed to the bed sore through the opening to assist in healing thereof.

It should also be apparent that the mattress construction may be used for seat cushions, bedrails, arm rests and other similar applications by fashioning the mattress core in the desired configuration and applying the cover in the manner previously described.

It can be seen that the mattress 35 construction provides a significant improvement for the support structure 20 and waste collection apparatus 64 and operation thereof. The support structure and waste collection apparatus advantageously permit patient defecation and cleaning to be easily accomplished without requiring assistance from nursing personnel. The patient may operate controls to elevate the saddle 70 through aperture 38 without the physical exertion which would be required to position a bed pan beneath the patient. Even if the waste collection apparatus is needed repeatedly throughout the day, it is readily available and easily operable. After the collection apparatus 64 has been utilized, it is simply lowered out of sight without requiring repositioning of the patient.

Another important feature of the waste collection apparatus is the manner in which the excreted wastes are collected and stored to minimize exposure of nursing personnel to risk of cross-contamination. The apparatus 64 provides a closed system for collecting and storing the wastes remote from the individual for subsequent disposal.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A patient support and waste collection system comprising:

a bed presenting a support surface which may be adjusted for moving a patient supported thereon to a sitting position;

a selectively inflatable mattress forming at least a portion of said support surface, said mattress comprising a foam core having an air permeable matrix structure and an exterior surface and a substantially impermeable outer covering bonded to at least a majority of the exterior surface of the core to permit inflation of the mattress;

said mattress comprising at least two abutting segments adapted to be temporarily spread apart laterally with respect to each other to define a selectively openable aperture in said mattress, for providing for collection of wastes excreted by the patient; and means for varying the inflation of said mattress.

2. The invention of claim 1, wherein said mattress outer covering comprises a coating applied to the outer surface of said foam core.

3. The invention of claim 2, wherein said coating penetrates said outer surface of said foam core to a predetermined depth.

4. The invention of claim 2, wherein said core comprises a reticulated foam core having between approximately 15 and 50 pores per inch.

5. The invention of claim 4, where said reticulated foam core has approximately 35 pores per inch.

6. The invention of claim 5, including means for moving said aperture between open and closed positions.

7. The invention of claim 5, wherein said mattress includes a foam pad attached to said outer covering atop the reticulated foam core.

8. A method for operating waste collection system comprising a support structure a selectively inflatable mattress on said support structure, said mattress comprised of a foam core having an air permeable matrix structure and a substantially impermeable outer covering, said mattress comprised of at least two abutting segments adapted to be temporarily spread apart laterally with respect to each other to define a selectively openable aperture in said mattress, and a waste collection device positioned beneath said aperture in said mattress, said method comprising the steps of:

(a) supplying a predetermined support pressure to said mattress;

(b) opening said aperture to bring the buttocks region of a patient supported on said mattress into contact with or closely spaced from said waste collection device while maintaining at least a portion of the buttocks on the mattress; and (c) closing said aperture and removing said buttocks region from said waste collection device after wastes have been excreted by the patient into the waste collection device.

9. The method of claim 8, including the step of deflating said mattress from said support pressure to an operational pressure when said aperture is opened to bring the patient buttocks region into contact with or closely spaced from the waste collection device.

10. The method of claim 9, including the step of reinflating said mattress from the operational pressure to a removal pressure which is greater than the support pressure when the aperture is closed to remove the patient buttocks region from the waste collection device.

11. The method of claim 10, including the step of returning said mattress to the support pressure from the 12. The method of claim 11, including the steps of moving said waste collection device in an upward direction when said aperture is opened to bring the patient's buttocks region into contact with or closely spaced from the waste collection device and then moving the waste collection device in a downward direction when said aperture is closed to remove the patient buttocks region from the waste collection device.

13. The method of claim 9, wherein said mattress is deflated to said operational pressure during opening of said aperture.

14. The method of claim 10, wherein said mattress is reinflated to said removal pressure during closing of said aperture.

15. The method of claim 8, including the steps of sensing an air pressure within the mattress at discrete regions located adjacent the aperture to thereby determine the position of a patient supported thereon and providing an alarm if the air pressure at one of said regions differs from the air pressure at another of said regions by more than a predetermined amount.

16. The method of claim 8, including the steps of sensing an air pressure within the mattress at discrete regions located adjacent the aperture to thereby determine the position of a patient supported thereon, and selectively adjusting the air pressure within less than all of the mattress regions to thereby move the patient at least horizontally with respect to the aperture.

* * * * *